US007897018B2

(12) United States Patent
O'Connor et al.

(10) Patent No.: US 7,897,018 B2
(45) Date of Patent: Mar. 1, 2011

(54) PROCESS FOR PRODUCING PAPERMAKER'S AND INDUSTRIAL FABRICS

(75) Inventors: Joseph G. O'Connor, Hopedale, MA (US); Maurice R. Paquin, Plainville, MA (US); Maryann Kenney, Foxboro, MA (US); Dana Eagles, Sherborn, MA (US); Jeffrey Scott Denton, Canton, NC (US); Lynn F. Kroll, Sherwood, WI (US); Jennifer L. Bowden, Pittsville, WI (US); Amit Ganatra, Attleboro, MA (US); John Michael Dempsey, Norton, MA (US)

(73) Assignee: Albany International Corp., Albany, NY (US)

( * ) Notice: Subject to any disclaimer, the term of this patent is extended or adjusted under 35 U.S.C. 154(b) by 624 days.

(21) Appl. No.: 11/899,245

(22) Filed: Sep. 5, 2007

(65) Prior Publication Data

US 2009/0056900 A1 Mar. 5, 2009

(51) Int. Cl.

| | |
|---|---|
| ***D21F 1/10*** | (2006.01) |
| ***D21F 7/08*** | (2006.01) |
| ***D21F 7/10*** | (2006.01) |
| ***D21F 7/12*** | (2006.01) |

(52) U.S. Cl. ..... 162/348; 162/358.2; 162/900; 162/902; 162/903; 162/904; 156/272.8

(58) Field of Classification Search ..... 162/348, 162/358.2, 900, 902–904; 139/383 AA, 383 A, 139/383 R; 156/304.1, 304.6, 272.8; 428/57, 428/58

See application file for complete search history.

(56) References Cited

U.S. PATENT DOCUMENTS

| | | | | |
|---|---|---|---|---|
| 3,867,766 | A * | 2/1975 | Wagner | 34/95 |
| 3,973,064 | A | 8/1976 | Paine | |
| 4,032,382 | A | 6/1977 | Obeda | |
| 4,156,626 | A | 5/1979 | Souder | |
| 4,401,137 | A | 8/1983 | Cannon | |
| 4,501,782 | A | 2/1985 | Weatherly et al. | |
| 4,701,229 | A | 10/1987 | Arakawa et al. | |
| 4,906,320 | A | 3/1990 | Powers | |

(Continued)

FOREIGN PATENT DOCUMENTS

| | | | |
|---|---|---|---|
| CA | 2552009 | A | 2/2007 |

(Continued)

OTHER PUBLICATIONS

Clear weld "The Concept" and Clearweld "The Clear Advantage, Clearweld Material Systems", pages from website www.clearweld.com (3 pages in total).

(Continued)

*Primary Examiner*—Eric Hug
(74) *Attorney, Agent, or Firm*—Frommer Lawrence & Haug LLP; Ronald R. Santucci; Vivek Shankam

(57) ABSTRACT

The invention discloses herein the use of short wavelength infrared energy to selectively control the locations where thermal fusing or bonding takes place or does not take place in an industrial fabric. Also, the method involves forming a mushroom cap on the tail of a fiber/yarn or monofilament and also creating a surface pattern formation.

45 Claims, 2 Drawing Sheets

U.S. PATENT DOCUMENTS

| | | | | |
|---|---|---|---|---|
| 5,085,917 | A * | 2/1992 | Hodnett, III | 428/193 |
| 5,170,031 | A | 12/1992 | Russell et al. | |
| 5,204,150 | A | 4/1993 | Davenport | |
| 5,334,289 | A | 8/1994 | Trokhan et al. | |
| 5,391,419 | A | 2/1995 | Davenport | |
| 5,464,488 | A | 11/1995 | Servin | |
| 5,501,759 | A | 3/1996 | Forman | |
| 5,554,467 | A | 9/1996 | Trokhan et al. | |
| 5,571,590 | A | 11/1996 | Schultz et al. | |
| 5,624,790 | A | 4/1997 | Trokhan et al. | |
| 5,670,230 | A | 9/1997 | Schlueter, Jr. et al. | |
| 5,674,663 | A | 10/1997 | McFarland et al. | |
| 5,686,639 | A | 11/1997 | Cohen | |
| 5,693,187 | A | 12/1997 | Ampulski et al. | |
| 5,711,847 | A | 1/1998 | Rajala et al. | |
| 5,713,399 | A | 2/1998 | Collette et al. | |
| 5,721,032 | A | 2/1998 | Parker et al. | |
| 5,731,063 | A | 3/1998 | Schultz et al. | |
| 5,740,314 | A | 4/1998 | Grimm | |
| 5,783,377 | A | 7/1998 | Mee et al. | |
| 5,837,103 | A | 11/1998 | Trokhan et al. | |
| 5,840,147 | A | 11/1998 | Grimm | |
| 5,843,265 | A | 12/1998 | Grimm | |
| 5,871,887 | A | 2/1999 | Trokhan et al. | |
| 5,939,176 | A | 8/1999 | Yook | |
| 6,099,670 | A | 8/2000 | Louks et al. | |
| 6,162,518 | A | 12/2000 | Korfer | |
| 6,491,794 | B2 | 12/2002 | Davenport | |
| 6,517,650 | B2 | 2/2003 | Couillard et al. | |
| 6,547,903 | B1 | 4/2003 | McNichols et al. | |
| 6,547,904 | B1 | 4/2003 | Young | |
| 6,656,315 | B2 | 12/2003 | Sallavanti et al. | |
| 6,702,927 | B2 | 3/2004 | Moriarty et al. | |
| 6,763,855 | B2 | 7/2004 | Rougvie | |
| 6,896,771 | B2 * | 5/2005 | Best et al. | 428/193 |
| 7,022,208 | B2 * | 4/2006 | Davenport et al. | 162/358.2 |
| 7,393,434 | B2 | 7/2008 | Kornett | |
| 2003/0221739 | A1 | 12/2003 | Billings | |
| 2004/0056006 | A1 | 3/2004 | Jones et al. | |
| 2004/0126569 | A1 | 7/2004 | Davenport | |
| 2005/0102763 | A1 | 5/2005 | Eagles | |
| 2007/0028997 | A1 | 2/2007 | Best | |
| 2007/0235155 | A1 | 10/2007 | Best et al. | |

FOREIGN PATENT DOCUMENTS

| | | | |
|---|---|---|---|
| DE | 39 21 712 | C | 9/1990 |
| DE | 20 2006 004 624 | U1 | 7/2006 |
| EP | 0 947 623 | A | 10/1999 |
| FR | 2 874 188 | A | 2/2006 |
| GB | 2232637 | | 12/1990 |
| JP | 09-207223 | | 8/1997 |
| WO | WO 96/40517 | | 12/1996 |
| WO | WO 99/16964 | A | 4/1999 |
| WO | WO 99/53237 | | 10/1999 |
| WO | WO 00/02723 | | 1/2000 |
| WO | WO 01/58997 | | 8/2001 |
| WO | WO 02/38677 | | 5/2002 |
| WO | WO 02/057353 | | 7/2002 |
| WO | WO 2004/055265 | A | 7/2004 |
| WO | WO 2006/074105 | A | 7/2006 |

OTHER PUBLICATIONS

IPAC "Near, Mid & Far Infrared" pages from website www.ipac.caltech.edu (5 pages in total).

International Search Report and Written Opinion issued by European Patent Office for International Application PCT/US2008/074388, mailed Jan. 1, 2009 (corresponding to U.S. Appl. No. 11/899,232).

International Search Report and Written Opinion issued by European Patent Office for International Application PCT/US2008/074312, mailed Mar. 10, 2009 (corresponding to U.S. Appl. No. 11/899,245).

Backmann, Reinhard: "Textilschweißen—Thermisches Fügen und Verbinden von Textilien für Orthopädie- und Medizintechnik", Jan. 2004, retrieved from the Internet URL:http://www.grin.com/e-book/111374/textilschweissen-thermisches-fuegen-und-verbinden-von-textilien-fuer-orthopaedie, (retrieved on Nov. 10, 2008), total 21 pages (in German).

Anonymous: "High Frequency Technology", Aug. 10, 2003, retrieved from the Internet URL:http://web.archive.org/web/20030810015427/http://rfwelding.com/hpage07.htm, (retrieved on Nov. 10, 2008), total 5 pages (in English).

"Schneiden Schweissen und Siegeln Mittels Utraschall-Beruehrungslos und Verschleissfrei", *Deutscher Drucker*, 31 Sep. 21, 1995 No. 35, p. G29 (in German).

* cited by examiner

PROCESS FOR PRODUCING PAPERMAKER'S AND INDUSTRIAL FABRICS

FIELD OF THE INVENTION

The invention disclosed herein relates to the use of short wavelength infrared energy to weld or melt selected locations in paper machine clothing ("PMC") and other industrial and engineered fabrics.

INCORPORATION BY REFERENCE

All patents, patent applications, documents and/or references referred to herein are incorporated by reference, and may be employed in the practice of the invention.

BACKGROUND OF THE INVENTION

The present invention relates to the papermaking arts including fabrics and belts used in the forming, pressing and drying sections of a paper machine, and to industrial process fabrics and belts, TAD fabrics, fabrics/belts used for textile finishing processes such as conveying, tannery belts, engineered fabrics and belts, along with corrugator belts generally.

The fabrics and belts referred to herein may include those also used in the production of, among other things, wetlaid products such as paper and paper board, and sanitary tissue and towel products made by through-air drying processes; corrugator belts used to manufacture corrugated paper board and engineered fabrics used in the production of wetlaid and drylaid pulp; in processes related to papermaking such as those using sludge filters and chemiwashers; and in the production of nonwovens produced by hydroentangling (wet process), meltblowing, spunbonding, airlaid or needle punching. Such fabrics and belts include, but are not limited to: embossing, conveying, and support fabrics and belts used in processes for producing nonwovens; and filtration fabrics and filtration cloths.

Such belts and fabrics are subject to a wide variety of conditions for which functional characteristics need to be accounted. For example, during the papermaking process, a cellulosic fibrous web is formed by depositing a fibrous slurry, that is, an aqueous dispersion of cellulose fibers, onto a moving forming fabric in the forming section of a paper machine. A large amount of water is drained from the slurry through the forming fabric, leaving the cellulosic fibrous web on the surface of the forming fabric.

Such fabric structures are typically constructed from synthetic fibers and monofilaments by conventional textile processing methods. It is often desirable to selectively tailor the surface, bulk or edges of a fabric structure to affect or enhance a performance characteristic important to, for example, the papermaker, such as fabric life, sheet formation, runnability or paper properties.

Heat is commonly applied to dry, melt, sinter or chemically react a material incorporated into the fabric to achieve such structural changes. Since the fibers and monofilaments are commonly high molecular weight polyester, polyamide or other thermoplastic material, heat can affect these materials in a variety of adverse ways. For example, heat can cause (a) flow above the glass transition point of a thermoplastic material which effects dimensional changes, or (b) melting above the melt transition point.

U.S. Pat. Nos. 5,334,289; 5,554,467 and 5,624,790 relate to a papermaking belt made by applying a coating of photosensitive resinous material to a reinforcing structure which has opaque portions and then exposing the photosensitive material to light of an activating wavelength through a mask which has transparent and opaque regions. The light also passes through the reinforcing structure.

U.S. Pat. No. 5,674,663 relates to a method for applying a curable resin, such as a photosensitive resin, to a substrate of a papermaker's fabric. A second material is also applied to the substrate. After the photosensitive resin is cured, the second material is removed, leaving a patterned portion of the cured resin.

U.S. Pat. Nos. 5,693,187; 5,837,103 and 5,871,887 relate to an apparatus for making paper which comprises a fabric and a pattern layer joined to the fabric. The fabric has a relatively high UV absorbance. This prevents actinic radiation applied to cure the pattern layer from scattering when the radiation penetrates the surface of the pattern layer. By limiting the scattering of radiation beneath the surface of the pattern layer, extraneous material is minimized in the regions of the fabric where it is desired not to have pattern layer material.

For fabrics such as those used for the forming of paper and tissue products, or for the production of tissue/towel or through-air-drying "TAD" fabrics, such fabrics are often times joined by a seam. In this instance, the fabric is usually flat woven. Each fabric edge has a "fringe" of machine direction ("MD") yarns. This fringe is rewoven with cross machine direction ("CD") yarns in the same basic pattern as the fabric body. This process of seaming to make endless is known to those skilled in the art. The seam area therefore contains MD yarn ends. The strength of the seam is dependent upon the MD yarn strength, the number of MD and CD yarns used, and the crimp in the MD yarns themselves that physically "lock" themselves around CD yarns to an extent. Those MD yarn ends, when the fabric is under operating tension on, for example, a papermaking or tissue/towel making machine, can literally slip past one another and pull out. The "ends" themselves then protrude above the fabric plane causing small holes in the paper/tissue product or can eventually slip enough so that ultimately, the fabric seam fails and the fabric pulls apart.

To minimize this, the yarns in the seam are usually sprayed or coated with an adhesive. Unfortunately, this can alter the fluid handling properties of the seam area, and the adhesive can also be abraded and wear off. In addition, the width of the seam area, as measured in the MD, formed using conventional techniques typically range, for example, anywhere between three and a half to twenty inches or even more. For many reasons, it is desirable to reduce the seam area.

While the application of heat to partially melt or fuse yarns to each other in the seam area has been contemplated, the use of heat generally may cause unacceptable change to the fluid handling properties of the seam area since all yarns are affected and the seam may, for example, have a resultant different air permeability than the fabric body.

The modification of synthetic material, particularly fibers/yarns or monofilaments to absorb short wavelength infrared energy to create the possibility of having both heat absorbing and non-absorbing fibers/yarns or monofilaments is different, however, in the present invention than that in the patents described above.

Accordingly, an alternative method to enhance the seam strength/resistance to yarn pull out is desired.

SUMMARY OF THE INVENTION

Surprisingly, the deficiencies of the art are overcome by the objects of the invention which are described below.

One object of the invention is to provide a process of using a short wavelength infrared energy absorber which is added to or coated onto a fiber/yarn or monofilament used to make paper machine clothing and other industrial and engineered fabrics. The use of the short wavelength infrared energy absorber allows for the use of short wavelength infrared energy effectively, which had heretofore been somewhat unsuitable for use in the making of the fabrics of the invention. The described process also allows for selective bonding or fusion of the fiber/yarns or monofilaments to other fiber/yarns or monofilaments.

Another object of the invention is to provide a process for selective bonding or fusion upon application of short wavelength infrared energy absorption material onto a surface of the fabric via the use of short wavelength infrared energy.

Another object of the invention is to provide a method of making a "mushroom cap" at the end of a fiber/yarn or monofilament tail in the seam area of the fabric. This object of the invention results in fabrics with enhanced seam strength previously unavailable in the art.

Another object of the invention is to form a fabric with a durable seam having a) the ability to remain intact when subjected to high pressure showers, and b) the ability to remain intact until the body of the fabric wears out from normal wear, wherein the seam width as measured in the MD is a fraction of the width of a normal seam that is formed using a conventional technique of equal strength. This fraction can be 0.7 or lower, preferably 0.5 or lower, and most preferably 0.3 or lower. For example, if "X" is the width of a seam in MD according to prior practice with a conventional seaming method, then the width of the seam formed according to the instant invention is, for example, 0.7X or lower, preferably 0.5X or lower, and most preferably 0.3X or lower whilst being of equal strength.

Another object of the present invention is to form seam of greater strength when the seam width in the MD is the same as normally used to form a conventional seam.

Another object of the invention is to provide paper machine clothing and other industrial and engineered fabrics made by the above described processes.

These objects and further embodiments of the invention will be described in more complete detailed description identified below.

DETAILED DESCRIPTION OF THE INVENTION

Figure 1:
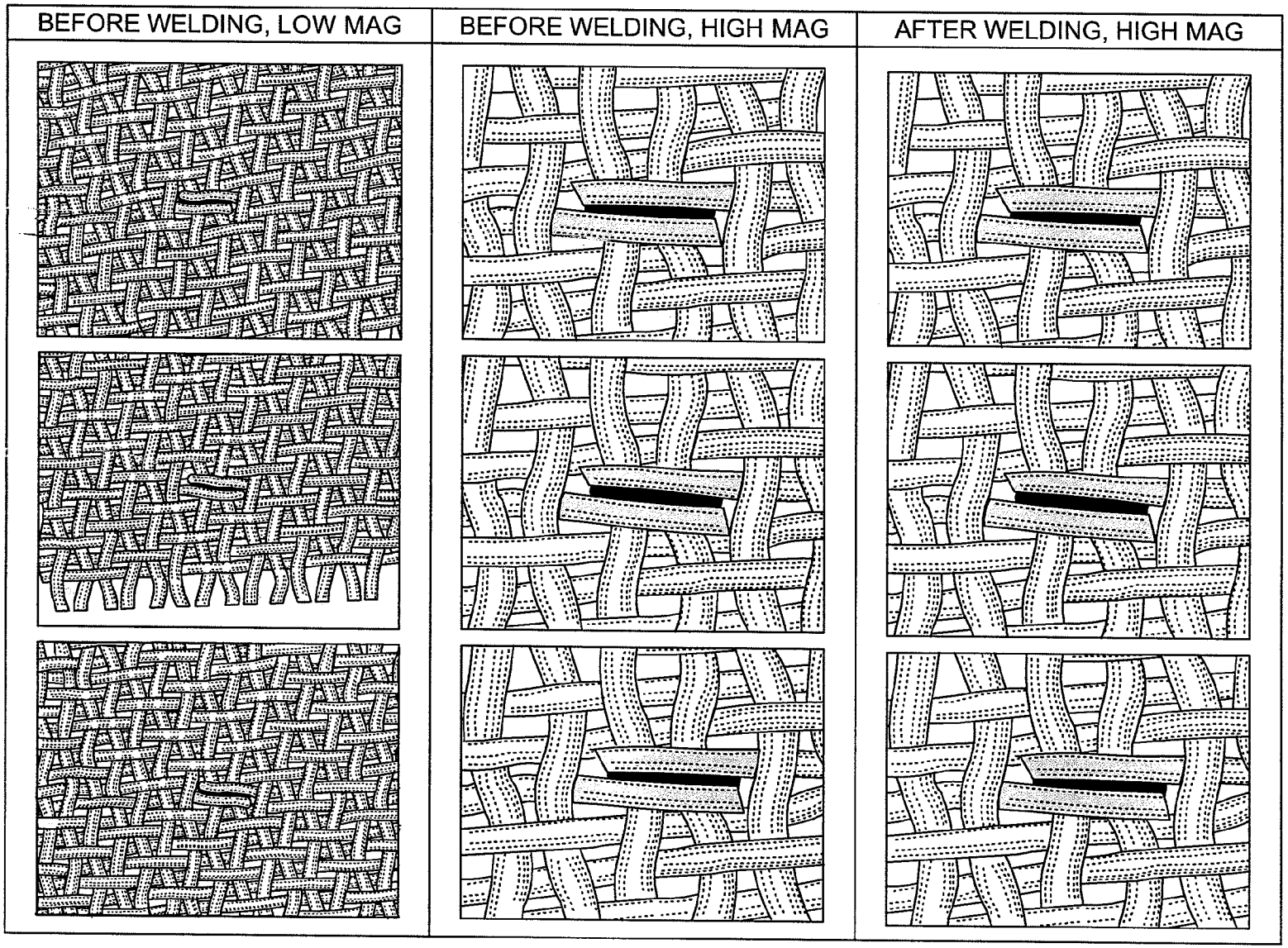
FIG. 1 illustrates selective bonding.

The invention encompasses a method for processing paper machine fabrics, engineered fabrics, corrugator belts, fabrics/belts used for textile finishing processes such as conveying, tannery belts and other industrial fabrics to enhance various performance characteristics such as, but not limited to, seam integrity. Paper machine fabrics, include but are not limited to forming, pressing, drying fabrics, process belts and TAD fabrics. Generally, the invention disclosed herein utilizes a combination of short wavelength infrared energy absorbing and non-short wavelength infrared absorbing energy fibers/yarns or monofilaments in a single fabric structure such that the short wavelength infrared energy absorbing fiber/yarns or monofilament can be thermally fused or bonded to another fiber/yarns or monofilament which comes into contact with the short wavelength infrared energy absorbing fiber/yarns or monofilament. This thermal fusing or bonding can be controlled in a selective manner, i.e., one can select and control the locations where thermal fusing or bonding takes place or does not take place. Various examples of selective bonding are recited herein and should in no way be considered exclusive. The means by which this happens is described as follows.

Initially, carbon black is a typical short wavelength infrared energy absorber that can be incorporated into a monofilament material to make the monofilament short wavelength infrared energy absorbing. Other short wavelength infrared energy absorbing materials may also be used or incorporated into the monofilament material. These include, but are not limited to, black ink, conjugated cyclohexene/cyclopentene derivatives (see U.S. Pat. No. 5,783,377, which is incorporated by reference), quinone diimmonium salts (see U.S. Pat. No. 5,686,639, which is hereby incorporated by reference), metalloporphyrins, metalloazaporphyrines, Fischer base dyes (see U.S. Pat. No. 6,656,315, which is hereby incorporated by reference) and mixtures thereof.

The primary requirement of the short wavelength infrared energy absorber is the feature that the material be a short wavelength infrared energy absorber and that the material have the chemical and thermal stability necessary for the material to be incorporated into the monofilament material either via melt compounding or a dyeing process.

Medium to long wavelength infrared energy in approximately 5.0 μm-15.0 μm wavelength band may be used in textile industrial heating applications because most synthetic materials absorb the energy of these bands. On the other hand, short wavelength infrared energy typically between approximately 0.7 μm-5.0 μm is rarely used since synthetic materials do not absorb this energy efficiently. The transparency of common synthetic fibers and monofilaments to short wavelength infrared energy can be modified by the addition of an additive such as carbon black or by applying a particular dye to the material. This creates the possibility of having both heat absorbing and non-absorbing synthetic fibers/yarns or monofilaments made of the same polymer, for example polyester or polyamide. This can also create novel fabric structures with improved properties.

An example is the addition of a few percent by weight of carbon black to a short wavelength infrared energy transparent material to change it to an absorber of short wavelength infrared energy. Another example is using a dye or pigment by coating or locally applying (e.g., ink jet or transfer coating) a dye to the fabric structure in precise and predetermined locations.

A fabric structure is designed and created with the predetermined placement of short wavelength infrared energy absorbing and non-short wavelength infrared energy absorbing fibers/yarns or monofilaments via the product design and control of the manufacturing process. For example, a multilayer forming fabric is woven of monofilament yarns. The fabric may have paired machine direction MD or cross machine direction CD binder yarns and may be designed such that selected pairs of binder yarns are made from short wavelength infrared energy absorbing monofilament. During the finishing process, the structure is exposed to short wavelength infrared energy for a controlled time of exposure. The intensity and exposure are controlled such that the pair of binder yarns (adjacent to each other and in contact with each other at specific places in the fabric structure) made from short wavelength infrared energy absorbing material heat up and fuse to each other where they contact each other and/or to adjacent yarns.

An important concept in this invention is the greater latitude in materials selection that the process affords. For instance, this process of selective energy absorption gives one the ability to have both energy absorbing and non-energy absorbing areas of the same polymer material in the fabric structure. Absorbing areas will be selectively affected by short wavelength infrared energy. As another example, one can include both short wavelength infrared energy absorbing and non-absorbing polyamide fiber/yarns or monofilaments. The absorbing fiber/yarn or monofilament could be in one layer of a multilayer structure; blended uniformly within the structure; located only on or near an edge; at the top or bottom surfaces of the structure; or in the seam area. The short wavelength infrared energy would then selectively affect the absorbing fiber/yarn or monofilament to produce a desired change in the structure, such as, but not limited to bonding and fusion at desired locations.

The present invention envisions the selective melting of yarn material(s) that absorb short wavelength infrared energy in the presence of commonly used synthetic fibers and monofilaments that are mostly transparent to, and therefore unaffected by, short wavelength infrared energy. This method provides a previously unrecognized, efficient and versatile process to produce either novel and/or improved fabric structures.

For example, forming fabrics woven with selected monofilament binder yarns can be made from, for example, MXD6 (a class of nylon which is a polymer of 1,3-benzenedimethanamine [(metaxylenediamine, MXDA) and adipic acid], polymer available from Mitsubishi Gas Chemical Co., Inc. and Solvay Advanced Polymers, LLC and carbon black. The carbon black acts as a short wavelength infrared energy absorber. As a further illustration, MXD6 monofilaments that are free of carbon black may be used in other selected pairs of binder yarns. These binder yarns will not absorb the short wavelength infrared energy to any extent, and as a result, these binder yarns will not fuse to each other where they contact each other. In this example, the thermal fusing of a pair of adjacent binder yarns can be used to minimize the planarity where the binder yarns pass by each other in the fabric weave pattern and as a result, reduce the potential for sheet marking during papermaking.

Selective bonding could be applied to all types of PMC and other industrial and engineered fabrics with desirable effects. On a woven forming fabric, for example, some of the monofilaments could be modified to absorb energy in the short wavelength infrared energy upon the application of short wavelength infrared energy absorbing material to form locally fused areas. Local fusing can be made in such a way to reduce permeability in the fused area. One can use local fusing to create patterns of reduced permeability in a forming fabric and thereby produce a desired watermark in paper made with this forming fabric. In particular, edge wear strips to prevent fabric unraveling might be designed in this manner. The same technique could be used, for example, on other fabric types to control fabric permeability.

Selected bonding may also be used in a variety of ways to modify fabric structures, such as, but not limited to, increased durability, edge sealing enhanced seam strength, and allow for forming fabrics with more open designs for better drainage in some cases. Again, the advantages of localized fusion or melting of yarns or fibers opens up both the material choices and minimizes effects on the structure other than the desired bond area. The application of the short wavelength infrared energy absorbing material on the fiber/yarn or monofilament enables absorption of high amounts of infrared energy, causing stretching of bonds in the material, and creating kinetic energy within the molecules of the fiber. This generates heat in the localized regions, which can be used in fusing or melting the fibers.

The invention also encompasses a method for fusing/bonding yarns together in, for example, TAD fabric and forming fabric seams. It is common for TAD seams to be constructed such that two warp yarn ends are overlapped in the seam area. In the area of overlap, the warp yarn ends pass by one another and can be brought into contact with each other. As illustrated in FIG. 1, specific short wavelength infrared absorbing inks or dyes can be applied to the area between two warp yarns that overlap. The fabric is then exposed to short wavelength infrared energy for a few seconds. The bulk of the fabric was unaffected while the two warp yarns were fused/bonded together and in some cases to the CD yarns in the seam area in the zone where the dye was deposited.

The monofilament material that may be used to carry the short wavelength infrared energy absorber and thereby creating heat absorbing monofilaments includes the full range of polyamides, polyaramids, polyesters, polyetherketones, polyetheretherketones (PEEK), polyethylene terephthalate, polybutylene terephthalate, polyethylene naphthalate (PEN), polyolefins, polypropylenes, polyurethanes and mixtures thereof known in the application of paper machine clothing and other industrial and engineered fabrics. The primary requirement of the monofilament material is that it have the chemical and mechanical properties suitable for application with paper machine clothing and other industrial and engineered fabrics.

With respect to controlling the intensity and exposure of the short wavelength infrared energy source, two basic methods are envisioned. One method uses a focused short wavelength infrared light as a source of energy whereby the beam of short wavelength infrared light is directed at the desired area of the fabric while the length of exposure and the level of intensity is controlled to produce selective welds and bonded areas. Alternatively, the fabric may be exposed for a controlled time of exposure to a high intensity short wavelength infrared lamp such as a quartz lamp. In the case of a high intensity short wavelength infrared lamp, the distance between the lamp and the sample to be exposed is important to determining the proper exposure. The area of exposure is controlled by a mask that is short wavelength infrared impenetrable and the mask has a desired "pattern" of areas wherein the energy can or cannot pass through. The areas selected and exposed as a result of the mask and energy source are welded or fused together as a result. Alternatively, a mask may not be required and the exposure conditions of time and distance from the energy source may be the means of controlling the areas to be welded/fused.

The monofilament containing the short wavelength infrared energy absorber may be incorporated into the fabric during the weaving process. Alternatively, the monofilament containing the short wavelength infrared energy absorber may be introduced into the woven structure after the fabric has been woven. The monofilament could be incorporated into the seam area of the fabric during seaming as a shute (weft) CD yarn.

The fusing/bonding of yarns together in the seam area i.e., bonding of the MD fiber/yarn crossing with CD fiber/yarn or bonding adjacent and/or matching MD fiber/yarn pairs or bonding terminal ends of MD fiber/yarns to other MD or CD fiber/yarns, results in a fundamentally different way in which stress is transferred in a seam. Conventional seams transfer stress through friction in the crimped yarns of the seam. Seams made according to the present invention transfer stress "through the bonds" between yarns. The result is that the seam durability is no longer determined by friction alone, but by the strength of these bonds as well.

Fabric seam terminations formed according to the instant invention could be of any length and/or width. Termination size could change with new products and also the fact that the goal is to make the terminations shorter and the seam area itself in the MD as short as possible, or to form a seam of greater strength when the seam width in the MD is the same as normally used to form a conventional seam. Preferably, the seam width as measured in the MD is a fraction of the width of a normal seam or a seam that is formed using a conventional technique of equal strength. This fraction can be 0.7 or lower, preferably 0.5 or lower, and most preferably 0.3 or lower. For example, if "X" is the width of a seam in MD according to prior practice, or a conventional seaming method, then the width of the seam formed according to the instant invention is, for example, 0.7X or lower, preferably 0.5X or lower, and most preferably 0.3X or lower whilst being of equal strength.

As a further example, a short length (about 5 mm) of black polyethylene terephthalate (PET) monofilament (a short wavelength infrared energy absorbing PET monofilament) was placed between two adjacent and matching PET warp monofilaments (non-short wavelength infrared energy absorbing) such that the PET warp monofilaments are being pressed against or brought into contact with the black PET monofilament. These structures would be exposed to a short wavelength infrared energy source such that the black PET monofilament heats up and fuses with the adjacent PET monofilaments. The short length of black PET monofilament provided a means to control the zone where fusing was desired. In this way, the thermal fusing may be selectively controlled. In this example, the thermal fusing that was described can be said to increase the durability of seams by fusing yarns together in the seam area.

As noted earlier, other short wavelength infrared energy absorbing materials other than carbon black make suitable absorbers. An advantage of some of these absorbers is that they are not black, but rather they have some color that is less prominent than black in the visible spectrum, i.e., in the visual sense to the human eye. As a result, monofilaments made with these materials are attractive in terms of creating a product where the fused position does not stand out as obvious to initial examination by a person if desired.

Fusing/bonding can be accomplished with chemically like polymeric monofilaments or fiber material fusing to chemically like polymeric monofilament or fiber materials. For example, PET monofilament will bond to PET monofilament. PET monofilament will also bond to monofilament made from a blend of 30% thermoplastic polyurethane and 70% PET. PET monofilament will also bond to PEN and PBT. PET monofilament will not bond to polyamide monofilaments made from polyamide 6, polyamide 6, 6, polyamide 6, 12, polyamide 6, 10 and chemically similar polyamides. Polyamide 6 monofilament will bond with polyamide 6, 12 monofilament as a further example of chemically like materials being able to bond to each other.

The invention also encompasses a method to create a mushroom cap at the end of a monofilament tail in the seam area of, for example, TAD or other types of fabrics that are seamed by methods known to those skilled in the art. This mushroom cap serves to further secure the monofilament in the seam area and allow the fabric to withstand high operating tensions without the seam failing and pulling apart. For the purposes of this invention, the mushroom cap is physically a part of the monofilament and possesses a diameter which is wider than the diameter of the monofilament prior to formation of the mushroom cap.

Figure 2:
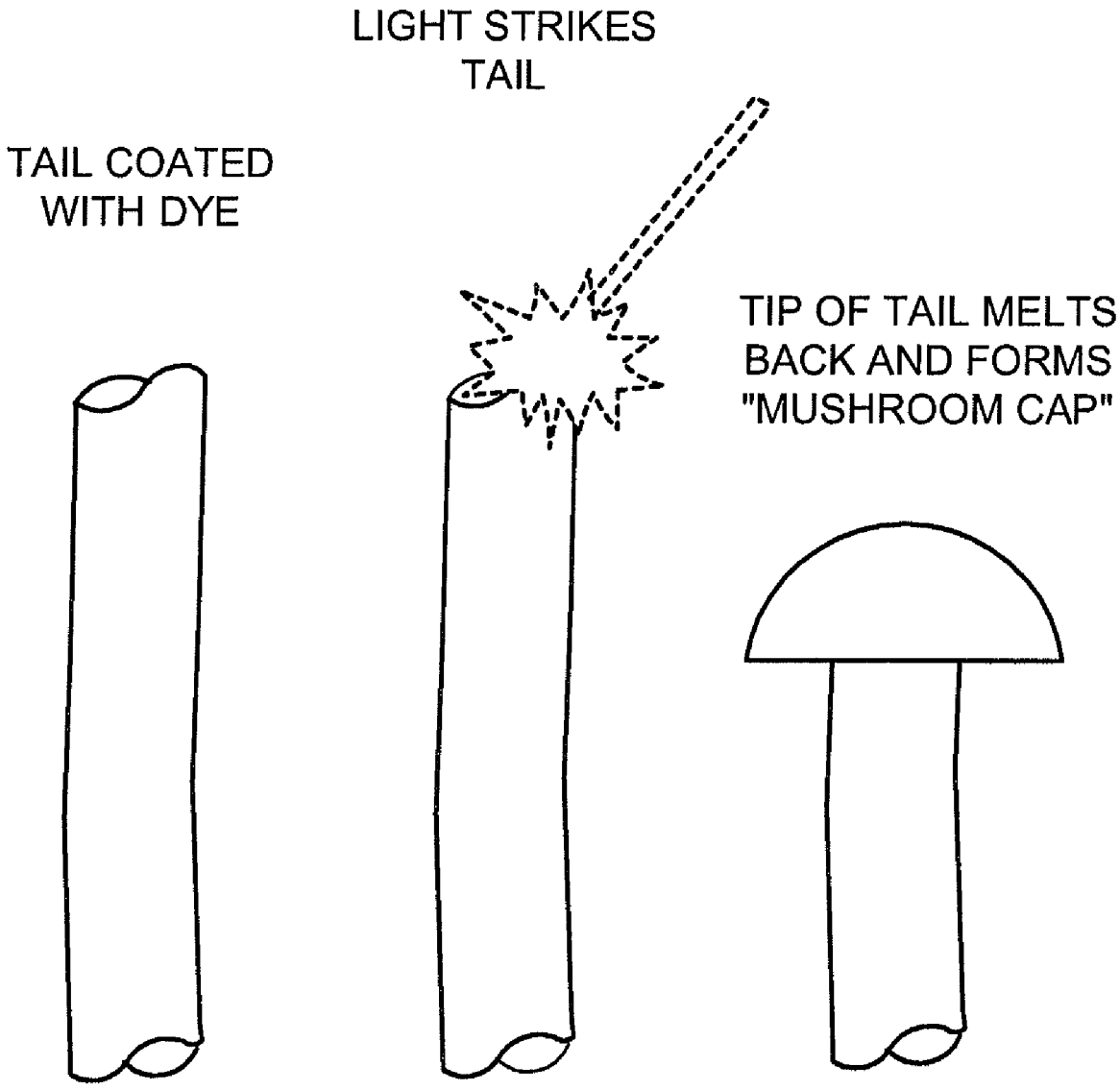
FIG. 2 presents a method for creating mushroom caps as a means of producing strong, durable seams.

The mushroom cap is created in the following manner (see, e.g., FIG. 2). A short wavelength infrared energy absorbing dye is coated or applied to the tail of the monofilament (step 1 of FIG. 2) in the seam area of the fabric. After this dye is applied, the tail of the monofilament is exposed to short wavelength infrared energy (step 2 of FIG. 2). The energy source emits energy at a specific wavelength that is absorbed by the short wavelength infrared energy absorbing dye, but not absorbed appreciably by the portion monofilament that is not coated with the short wavelength infrared energy absorbing dye. The tail of the monofilament coated with this dye will heat up and melt as a result of this specific absorption characteristic. Upon melting, the tail of the monofilament will recoil due to loss of molecular orientation and form a mushroom cap (step 3 of FIG. 2). Other portions of the monofilament that have not been coated with the special short wavelength infrared energy absorbing dye do not melt when exposed to the energy source. The result is a means to secure tails in the seam area such that the fabric can operate under higher tension without the seam failing and pulling apart.

The invention also encompasses the ability to effect change to the surface of a PMC fabric and other industrial and engineered fabrics. One concept would be to print a pattern on the surface of the fabric with a short wavelength infrared energy absorbing dye or pigment. Applying short wavelength infrared energy and possibly pressure would change porosity and/or permeability and/or surface topology locally in the printed pattern area on the fabric surface and create a three-dimensional pattern, and can be used to make a watermark, as an example. This can produce localized areas of fused surface surrounded by open, porous areas. Since the interior of the fabric is not melted or fused, there will be little or no unwanted effect on its general characteristic properties such as water removal capability.

A further embodiment of changing the surface of the fabric is to print a solid sheet of thermoplastic material with a desired pattern of short wavelength infrared energy absorbing pigment. This solid, impervious sheet could then be incorporated into the structure of a PMC fabric, for example on the surface layer of the fabric. Exposure to short wavelength infrared energy would cause the sheet to melt or shrink away only in the printed areas leaving behind an apertured layer. The result would be a sheet porous to air and water formed in situ without affecting or damaging other fibers below the printed sheet. This method could also use this to bond the sheet to the fabric.

Short wavelength infrared energy absorbing coating formulations can be applied, dried or cured without affecting the underlying structure.

Thus, the present invention its objects and advantages are realized, and although preferred embodiments have been disclosed and described in detail herein, its scope and objects should not be limited thereby; rather it may embrace other applications apparent to one skilled in the art, and accordingly, its scope should be determined by that of the appended claims.

We claim:

1. A method of treating a fiber/yarn or monofilament which is incorporated into paper machine, industrial or engineered fabrics comprising the steps:

(a) providing a material which absorbs short wavelength infrared energy along at least one localized length of a fiber/yarn or monofilament which is normally transparent to short wavelength infrared energy; and (b) selective melting, fusing, or bonding the fiber/yarn or monofilament to itself or another fiber/yarn or monofilament by exposing the fiber/yarn or monofilament to short wavelength infrared energy.

2. The method of claim 1, wherein the fabric is selected from the group consisting of forming, pressing, and drying fabrics, process belts, TAD fabrics, engineered fabrics, fabrics used for textile finishing processes such as conveying, tannery belts and corrugator belts.

3. The method of claim 1 wherein the short wavelength infrared energy source has a wavelength of about 0.7 μm-5.0 μm.

4. The method of claim 1, wherein the material which absorbs short wavelength infrared energy is an additive, coating or dye.

5. The method of claim 4, wherein the dye is selected from the group consisting of black ink, carbon black, conjugated cyclohexene/cyclopentene derivatives, a quinone diimmonium salt, a metalloporphyrin, a metalloazaporphyrine, a Fischer base dye and mixtures thereof.

6. The method of claim 1, wherein the fiber/yarn or monofilament comprises a polymer selected from the group consisting of polyamides, polyaramid, polyesters, polyetherketones, polyetheretherketones, polyolefins, polypropylenes, polyurethanes and mixtures thereof.

7. The method of claim 1 wherein the selective melting, fusing, or bonding involves selective application of the material which absorbs short wavelength infrared energy onto the fiber/yarn or monofilament.

8. The method of claim 1, wherein the application of the material which absorbs short wavelength infrared energy is on a tail of the fiber/yarn or monofilament and forms a mushroom cap upon exposure to short wavelength infrared energy wherein the mushroom cap secures the tails in a seam area of the fabric.

9. The method of claim 8, wherein the material is selected from the group consisting of black ink, carbon black, conjugated cyclohexene/cyclopentene derivatives, a quinone diimmonium salt, a metalloporphyrin, a metalloazaporphyrine, a Fischer base dye and mixtures thereof.

10. The method of claim 8, wherein the fiber/yarn or monofilament comprises a polymer selected from the group consisting of polyamides, polyaramids, polyesters, polyetherketones, polyetheretherketones, polyolefins, polypropylenes, polyurethanes and mixtures thereof.

11. The method of claim 1, wherein the absorbing material is arranged to form a pattern on a layer of a fabric formed.

12. The method of claim 11, wherein a pattern is created by printing a solid sheet of thermoplastic material with a desired pattern of short wavelength infrared energy absorbing pigment and incorporating the sheet on a layer of the fabric.

13. The method of claim 11, wherein the material is selected from the group consisting of black ink, carbon black, conjugated cyclohexene/cyclopentene derivatives, a quinone diimmonium salt, a metalloporphyrin, a metalloazaporphyrine, a Fischer base dye and mixtures thereof.

14. The method of claim 1, wherein the selective melting, fusing or bonding of the fiber/yarn or monofilament to itself or another fiber/yarn or monofilaments occurs in a seam area of the fabric.

15. The method of claim 14, wherein the tail of the MD fiber/yarn or monofilament is overlapped with another tail of another MD fiber/yarn or monofilament and in contact with each other and upon exposure to short wavelength infrared energy are welded together and/or to the CD yarns in the seam area of the fabric.

16. The method of claim 14, wherein a width of said seam area as measured in MD is a fraction of a width of a normal seam or a seam formed using conventional techniques of equal strength, said fraction being 0.7 or lower.

17. The method of claim 14, wherein a MD fiber/yarn crossing over with a CD fiber/yarn and in contact with each other, upon exposure to short wavelength infrared energy are welded together in the seam area of the fabric.

18. Paper machine clothing, corrugator belts, fabrics used for textile finishing processes such as conveying or tannery belt, industrial or engineered fabric produced by the method of claim 1, wherein the clothing, belts or fabric include a structure having at least one of: a desired permeability, an enhanced seam strength, or an improved drainage.

19. Paper machine clothing, corrugator belts, fabrics used for textile finishing processes such as conveying or tannery belt, industrial or engineered fabric produced by the method of claim 8.

20. Paper machine clothing, corrugator belts, fabrics used for textile finishing processes such as conveying or tannery belt, industrial or engineered fabric produced by the method of claim 11, wherein the clothing, belts or fabric include a structure having at least one of: a desired permeability, an enhanced seam strength, or an improved drainage.

21. Paper machine clothing, corrugator belts, fabrics used for textile finishing processes such as conveying or tannery belt, industrial or engineered fabric produced by the method of claim 14.

22. The method of claim 12, wherein said layer is a surface layer of the fabric formed.

23. The method of claim 14, wherein the fused/bonded seam area is stronger than a normal seam formed using conventional techniques of equal length in MD of the fabric.

24. The method of claim 16, wherein said fraction is 0.5 or lower.

25. The method of claim 24 wherein said fraction is 0.3 or lower.

26. A method of treating paper machine, industrial or engineered fabrics which comprises:

(a) providing a base structure comprising material which does not absorb short wavelength infrared energy; and (b) selectively coating the provided base structure with a coating formulation which absorbs short wavelength infrared energy, with said coating being for purposes of controlling the porosity, and/or durability of the fabric; and (c) exposing the coating and base structure to short wavelength infrared energy to produce a desired change in the porosity and/or durability of the base structure.

27. The method of claim 26, wherein the fabric is selected from the group consisting of forming, pressing, and drying fabrics, process belts, TAD fabrics, engineered fabrics, fabrics used for textile finishing processes such as conveying, tannery belts and corrugator belts.

28. The method of claim 26, wherein the coating formulation which absorbs short wavelength infrared energy contains a short wavelength energy absorbing additive or dye.

29. The method of claim 28, wherein the dye is selected from the group consisting of black ink, carbon black, conjugated cyclohexene/cyclopentene derivatives, a quinone diimmonium salt, a metalloporphyrin, a metalloazaporphyrine, a Fischer base dye and mixtures thereof.

30. The method of claim 26, wherein the fiber/yarn or monofilament comprises a polymer selected from the group consisting of polyamides, polyaramid, polyesters, polyetherketones, polyetheretherketones, polyolefins, polypropylenes, polyurethanes and mixtures thereof.

31. Paper machine clothing, corrugator belts, fabrics used for textile finishing processes such as conveying or tannery belt, industrial or engineered fabric produced by the method of claim 26, wherein the clothing, belts or fabric include a structure having at least one of: a desired permeability, an enhanced seam strength, or an improved drainage.

32. The method of claim 26 wherein the short wavelength infrared energy source has a wavelength of about 0.7 μm-5.0 μm.

33. A method of treating a fiber/yarn or monofilament which is incorporated into paper machine, industrial or engineered fabrics comprising the steps:

(a) providing a material which absorbs short wavelength infrared energy to a fiber/yarn or monofilament which is normally transparent to short wavelength infrared energy; and (b) selective melting, fusing, or bonding the fiber/yarn or monofilament to itself or another fiber/yarn or monofilament by exposing the fiber/yarn or monofilament to short wavelength infrared energy, wherein the application of the material which absorbs short wavelength infrared energy is on a tail of the fiber/yarn or monofilament and forms a mushroom cap upon exposure to short wavelength infrared energy wherein the mushroom cap secures the tails in a seam area of the fabric.

34. The method of claim 33, wherein the fabric is selected from the group consisting of forming, pressing, and drying fabrics, process belts, TAD fabrics, engineered fabrics, fabrics used for textile finishing processes such as conveying, tannery belts and corrugator belts.

35. The method of claim 33 wherein the short wavelength infrared energy source has a wavelength of about 0.7 μm-5.0 μm.

36. The method of claim 33, wherein the material which absorbs short wavelength infrared energy is an additive, coating or dye.

37. The method of claim 33, wherein the material is selected from the group consisting of black ink, carbon black, conjugated cyclohexene/cyclopentene derivatives, a quinone diimmonium salt, a metalloporphyrin, a metalloazaporphyrine, a Fischer base dye and mixtures thereof.

38. The method of claim 33, wherein the fiber/yarn or monofilament comprises a polymer selected from the group consisting of polyamides, polyaramids, polyesters, polyetherketones, polyetheretherketones, polyolefins, polypropylenes, polyurethanes and mixtures thereof.

39. Paper machine clothing, corrugator belts, fabrics used for textile finishing processes such as conveying or tannery belt, industrial or engineered fabric produced by the method of claim 33.

40. A method of treating a fiber/yarn or monofilament which is incorporated into paper machine, industrial or engineered fabrics comprising the steps:

(a) providing a material which absorbs short wavelength infrared energy to a fiber/yarn or monofilament which is normally transparent to short wavelength infrared energy; and (b) selective melting, fusing, or bonding the fiber/yarn or monofilament to itself or another fiber/yarn or monofilament by exposing the fiber/yarn or monofilament to short wavelength infrared energy, wherein the absorbing material is arranged to form a pattern created by printing a solid sheet of thermoplastic material with a desired pattern of short wavelength infrared energy absorbing pigment and incorporating the sheet on a layer of the fabric.

41. The method of claim 40, wherein said layer is a surface layer of the fabric formed.

42. The method of claim 40, wherein the material is selected from the group consisting of black ink, carbon black, conjugated cyclohexene/cyclopentene derivatives, a quinone diimmonium salt, a metalloporphyrin, a metalloazaporphyrine, a Fischer base dye and mixtures thereof.

43. The method of claim 40 wherein the short wavelength infrared energy source has a wavelength of about 0.7 μm-5.0 μm.

44. The method of claim 40, wherein the fiber/yarn or monofilament comprises a polymer selected from the group consisting of polyamides, polyaramids, polyesters, polyetherketones, polyetheretherketones, polyolefins, polypropylenes, polyurethanes and mixtures thereof.

45. Paper machine clothing, corrugator belts, fabrics used for textile finishing processes such as conveying or tannery belt, industrial or engineered fabric produced by the method of claim 40, wherein the clothing, belts or fabric include a structure having at least one of: a desired permeability, an enhanced seam strength, or an improved drainage.

* * * * *